US005167842A

United States Patent [19]

Vercelletto

[11] Patent Number: 5,167,842

[45] Date of Patent: Dec. 1, 1992

[54] INSTALLATION FOR THE FABRICATION OF CELLS TO BE SUBSEQUENTLY ASSEMBLED SIDE BY SIDE IN ORDER TO CONSTITUTE A CONSTRUCTION UNIT

[75] Inventor: Michel Vercelletto, Mamers, France

[73] Assignee: Entreprise Vercelletto, Mamers, France

[21] Appl. No.: 610,574

[22] Filed: Nov. 8, 1990

[30] Foreign Application Priority Data

Nov. 10, 1989 [FR] France ..... 89 14778

[51] Int. Cl.[5] ..... B28B 7/02; B28B 7/22; E04G 11/02

[52] U.S. Cl. ..... 249/27; 52/79.1; 52/125.4; 249/78; 249/84; 249/93; 249/129; 249/155; 249/158; 264/35; 264/297.9; 425/111; 425/123; 425/127

[58] Field of Search ..... 425/63, 88, 111, 117, 425/123, 127; 264/35, 253, 261, 297.9; 249/10, 11, 27, 83, 84, 93, 94, 119, 122, 124, 129, 152, 155, 157, 158, 176, 178, 184, 78; 52/79.1, 79.7, 79.14, 125.4, 127.2, 127.3, 745

[56] References Cited

U.S. PATENT DOCUMENTS

| | | | |
|---|---|---|---|
| 2,870.517 | 1/1959 | Henderson | 249/27 |
| 3,652.052 | 3/1972 | Van Der Lely | 249/27 |
| 3,834,110 | 9/1974 | Vercelleto | 264/261 |
| 4,042,659 | 8/1977 | Botting et al. | 249/27 |
| 4,372.906 | 2/1983 | Del Valle | 264/256 |
| 4,673,159 | 6/1987 | Schmidgall | 249/27 |
| 4,953,280 | 9/1990 | Kitzmiller | 249/119 |

FOREIGN PATENT DOCUMENTS

| | | | |
|---|---|---|---|
| 2324549 | 12/1973 | Fed. Rep. of Germany | 249/27 |
| 2141580 | 5/1976 | France . | |
| 2192220 | 6/1977 | France . | |
| 2416310 | 8/1980 | France . | |
| 269766 | 5/1971 | U.S.S.R. | 249/27 |
| 1028507 | 7/1983 | U.S.S.R. | 249/27 |
| 913842 | 12/1962 | United Kingdom . | |

*Primary Examiner*—Jay H. Woo
*Assistant Examiner*—James P. Mackey
*Attorney, Agent, or Firm*—Young & Thompson

[57] ABSTRACT

An installation for the fabrication of a series of cells constituting a single construction unit such as a dwelling house or a building story includes a fabrication bed which carries members for subdividing a single placement of concrete into serveral distinct slabs each forming part of one cell. These subdividing members are removably fixed on the fabrication bed in various positions according to the intended width of the cells. The subdividing members carry a device for temporarily immobilizing the two prefabricated panels placed on each side, each device being constituted by a post, the lower end of which can be fixed in an adjustable position on the corresponding subdividing member, and by an external shore of adjustable length.

10 Claims, 5 Drawing Sheets

FIG. 4
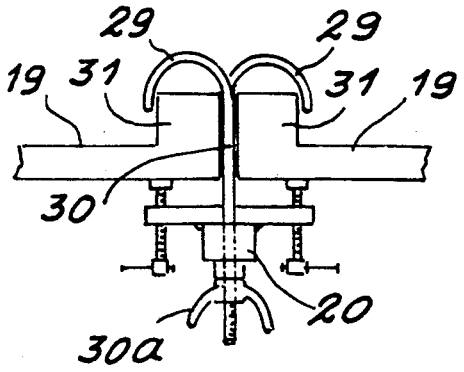
FIG. 6
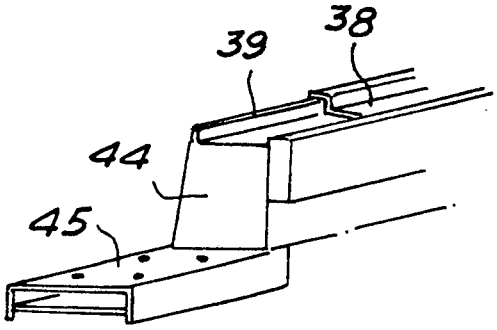
FIG. 5
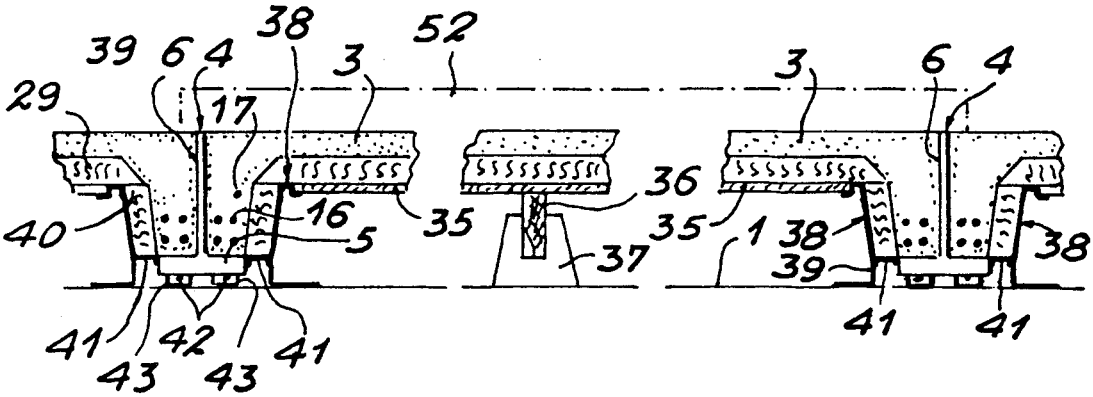
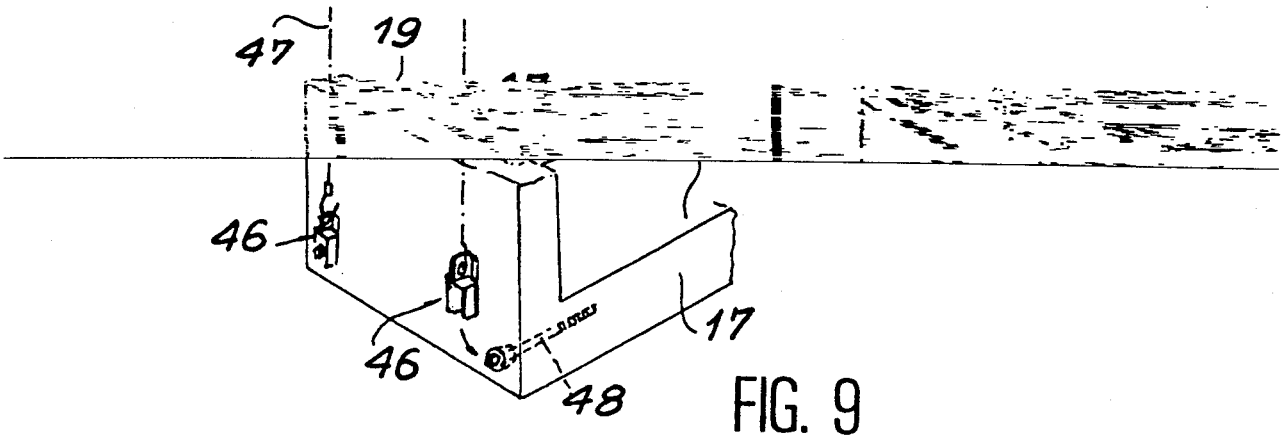
FIG. 9

INSTALLATION FOR THE FABRICATION OF CELLS TO BE SUBSEQUENTLY ASSEMBLED SIDE BY SIDE IN ORDER TO CONSTITUTE A CONSTRUCTION UNIT

BACKGROUND OF THE INVENTION

The present invention relates to the equipment employed for carrying out the method of construction which formed the subject of French patent No. 2,141,580 as well as the Certificates of Addition No. 2,192,220 and No. 2,416,310.

The method in question provides for manufacturing and equipping in the factory complementary cells which are intended to be subsequently assembled side by side in order to constitute a construction unit corresponding to a dwelling house or to one level of a building.

In accordance with this method, the different cells which are intended to form one construction unit are produced in the factory by placing them side by side and exactly in the respective positions which they are intended to occupy when subsequently assembled at the construction site. In accordance with an important feature of this method, the floor slabs of the different cells of any one unit are formed by a single placement of concrete on a molding bed which carries parallel partitioning members, said members being intended to separate the slabs which form part of each cell. Before placing the concrete, prefabricated panels are disposed vertically at the end of the different cells so as to form the external walls of these latter. These panels are then temporarily secured by suitable means so that their lower ends may subsequently be immovably joined to the slabs of the different cells at the time of casting of the slabs.

This method offers substantial advantages over the other methods of prefabrication which merely provide for the construction of separate panels to be assembled in situ. In fact, the method under consideration is not concerned with simple panels but involves the construction of complete cells which leave the factory with all their interior technical equipment such as, for example, cable ducts and electrical connections, water piping and sanitary equipment, heating pipes and radiators, and so on. Moreover, these cells have the advantage of being fabricated side by side in the respective positions which they are subsequently intended to occupy. In consequence, their subsequent assembly does not present any difficulty.

The equipment contemplated in French patents No. 2,141,580, No. 2,192,220 and No. 2,416,310 essentially includes a horizontal bed which is intended to serve as a bottom surface for molding the slabs of the different cells of any one unit as well as subdividing members which are carried by said bed and which consist in each case of a beam having a cross-section in the shape of an inverted T. In accordance with the method described in this French patent and its patents of Addition, these subdividing beams are also put to subsequent use as means for lifting completed cells with a view to discharging them. In addition, removable attachment means are provided for temporarily immobilizing prefabricated panels which are intended to be immovably joined to cell slabs.

However, by reason of its conceptual design, the use of this equipment is limited to the construction of cells having predetermined dimensions. In consequence, in order to be able to construct cells having different dimensions, provision must be made for a number of molding beds which are in turn different and for several sets of beams for subdividing the slabs. This accordingly limits the use of the method considered.

For the reasons given in the foregoing, the present invention is directed to a fabrication installation which is so designed as to eliminate this drawback in order to permit the construction of cells having various dimensions. However, the design of this installation is also such that this latter offers a certain number of improvements with respect to the equipment employed up to the present time for carrying out the method in question.

SUMMARY OF THE INVENTION

The installation in accordance with the invention is essentially distinguished by the following features:

the members for subdividing the slabs of the different cells are removably fixed on the fabrication bed by making use of attachment means for immobilizing them in a number of different positions according to the intended width of said cells, said subdividing members are adapted to carry at their extremities a device for temporarily immobilizing the two prefabricated panels placed on each side, each device aforesaid being constituted by a post whose lower end can be fixed in an adjustable position on the corresponding subdividing member, and by an external shore of adjustable length.

It is thus possible to vary not only the width of the cells to be constructed but also their length by immobilizing the prefabricated panels in different positions with respect to the corresponding sides of the molding bed.

In accordance with another distinctive feature, the present installation comprises a series of adjustable shuttering devices placed on the fabrication bed in order to constitute the bottom shutters of the slabs of the different cells, the edges of each of these shutters being constituted by sectional members slidably mounted on each other so as to have an adjustable length whilst the top wall is formed by plates of more or less substantial length removably placed on the top edges of the sliding sectional members.

In consequence, these shuttering devices can be adapted both to variations in length and to differences in width of the cells to be fabricated.

In accordance with yet another distinctive feature of the installation contemplated in the present invention, the ends of the beams for subdividing the cell slabs are each adapted to carry a vertical cheek pierced with holes which serve to stretch reinforcement steel rods or strands over the entire length of the edges of each cell in order to fabricate the corresponding side beams of the cell slabs by the prestressed concrete technique.

In accordance with still another distinctive feature, anchoring means are intended to be incorporated in the ends of the cells and are capable of receiving attachment fittings which serve to lift these latter one by one after fabrication while leaving the slab subdividing beams in position.

BRIEF DESCRIPTION OF THE DRAWINGS

FIG. 4 is a partial horizontal sectional view of a detail, taken along line IV—IV of FIG. 1.

FIG. 5 is a partial vertical sectional view taken along line V—V of FIG. 2 but after casting of the cell slabs.

FIG. 6 is a partial view in perspective showing one end of one of the sides of an adjustable shuttering device which forms part of the present installation.

FIG. 9 is a partial view in perspective of a cell with portions broken away and illustrating the anchoring means provided for lifting the cells after fabrication.

DETAILED DESCRIPTION OF THE INVENTION

Figure 1:
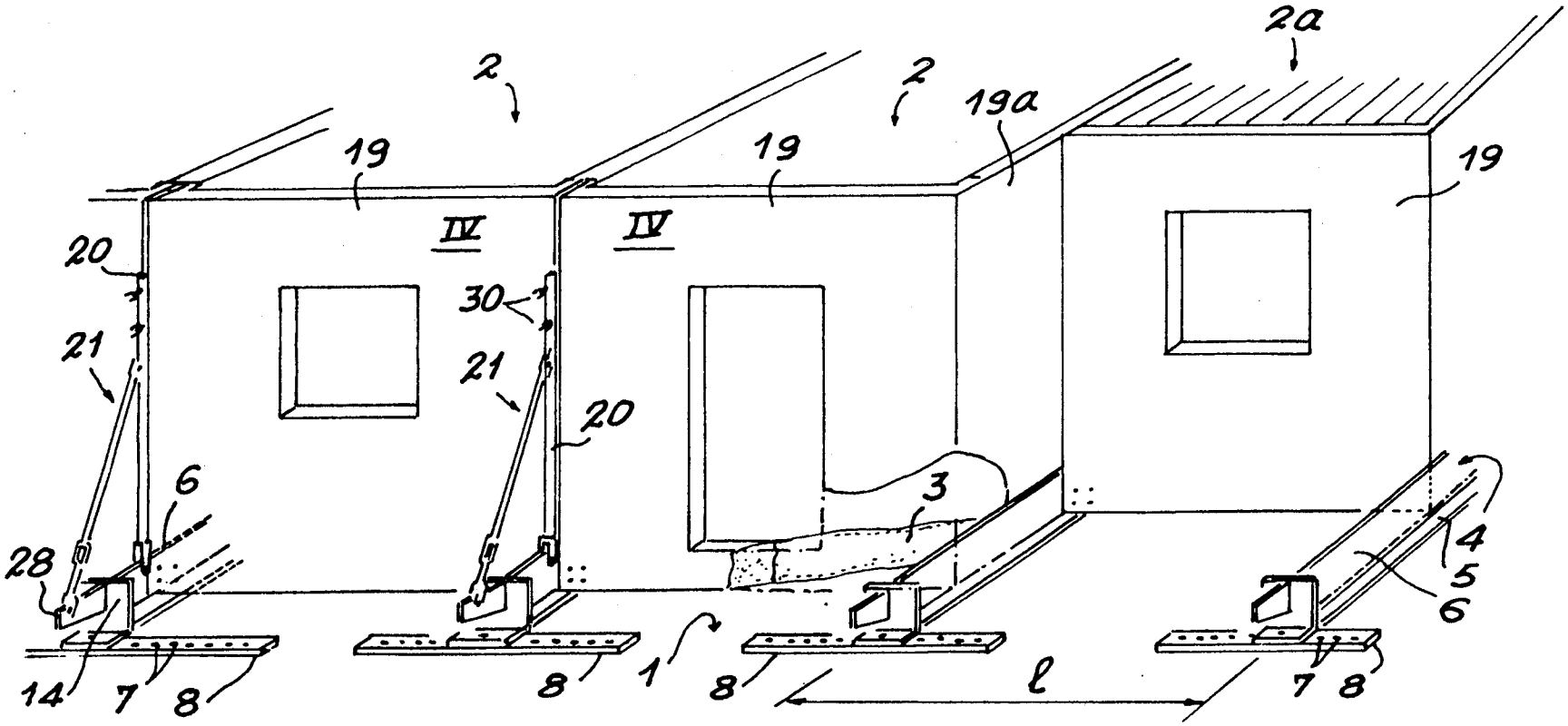
FIG. 1 is a schematic view in perspective of an installation of this type in which a few cells are shown during fabrication.
Figure 2:
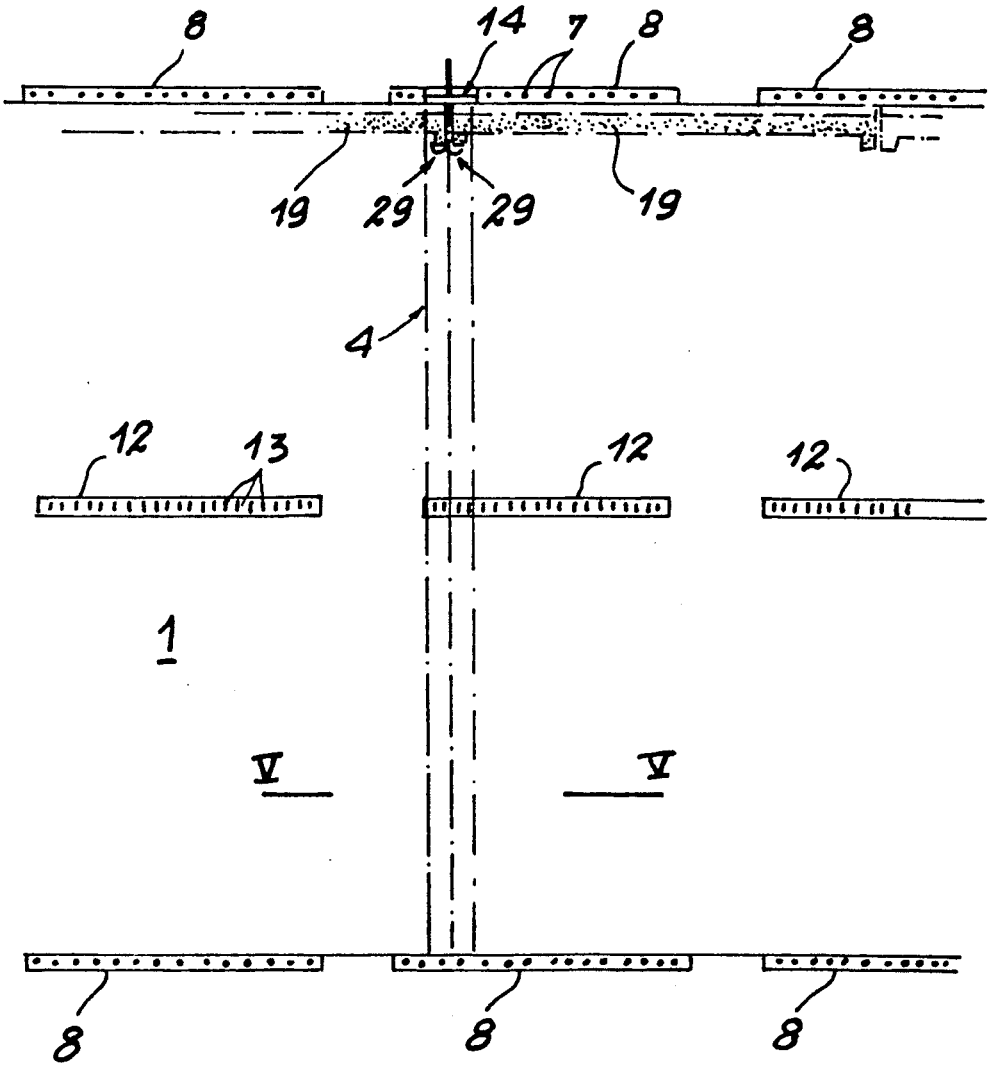
FIG. 2 is a partial top view of the fabrication bed which forms part of this installation.

The installation shown in the drawings includes a horizontal bed 1 for side-by-side construction of a series of complementary cells which are designated by the general reference 2 and which are subsequently intended to be assembled together so as to constitute a construction unit such as, for example, an individual dwelling house or a building level. Said bed 1 carries a series of horizontal members having the intended function of subdividing the slabs 3 of each cell while a single placement of concrete is being performed above said bed. Each of these members consists of a metal beam 4 having a cross-section in the shape of an inverted T, the horizontal flange 5 of which forms a sole-plate which is intended to be applied on the top face of the bed 1 whilst its vertical web 6 constitutes the slab subdividing member proper.

These different beams are placed in parallel relation on the bed 1 with a spacing which corresponds to the intended width 1 of the cells. In order to permit variation of this width from one cell to another or else between two different construction units, the beams 4 are held in position on the bed 1 by making use of removable attachment means which permit different positions of immobilization. In the example shown in the drawings, these attachment means consist of a series of holes 7 formed in metal plates 8 incorporated in the bed 1 opposite ot the mean position of attachment of each end of a beam 4. In the case considered, provision is made for fourteen holes 7 having the same spacing corresponding to a predetermined module, for example a spacing of 15 cm. Attachment of the ends of the beams 4 is carried out by means of one or a number of pins 9 engaged both in any one of said holes and in slots 10 formed in a shoe 11 which is added at the end of each beam.

For reasons which will be explained in greater detail below, fixing of the beams 4 in position is completed by immobilization of these latter on the bed 1 at an intermediate point of their length. To this end, a series of other metal plates 12 which are similar to the plates 8 are incorporated in said bed along the median line of this latter. Each plate 12 has a plurality of holes 13 of ovalized shape which are intended to receive locking-pins (not shown) engaged in holes provided at the center of the horizontal flange of each beam 4.

Said beams are provided at each end with a vertical cheek 14 placed at right angles with respect to their vertical web 6. The lower portion of said end cheek is provided with a series of holes 15 on each side of the position of the vertical web 6. Reinforcement rods or strands 16 to be incorporated within beams 17 provided on the edges of the slab 3 of each cell are intended to pass through said holes 15. Locking members 18 which can thus be mounted on the ends of said strands are intended to be applied against the corresponding cheek 14 in order to put them in tension prior to placement of the concrete in accordance with the prestressed concrete technique. It is in fact on account of the forces which are thus applied to the beams 4 at the time of prestressing that said beams are provided with an additional attachment to the bed 1 at an intermediate point of their length. This avoids any danger of buckling in the horizontal plane under the action of the prestress.

Figure 3:
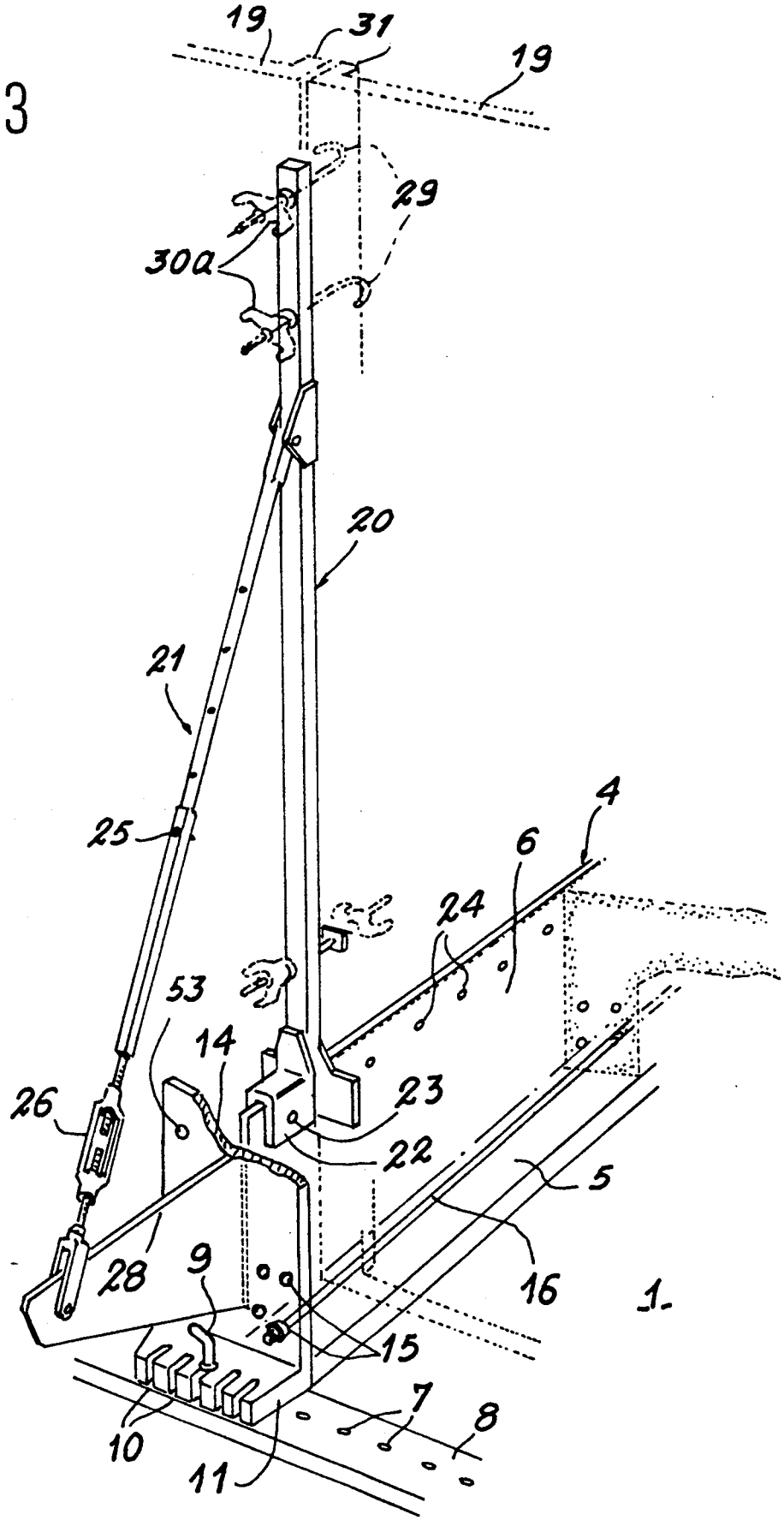
FIG. 3 is a view in perspective of the end of one of the subdividing beams and of the means which are separately mounted on this latter for holding the prefabricated panels in position.

Furthermore, the ends of the beams 4 are each adapted to serve as a support for a device having the function of temporarily immobilizing the prefabricated panels 19 which are intended to be incorporated at the end of each cell 2 so as to constitute the corresponding portion of the external wall of a construction unit. As illustrated more particularly in FIG. 3, each of these devices includes a vertical post 20 and an external shore 21 of adjustable length. Said post 20 is provided at its lower end with a stirrup-piece 22 which is intended to be mounted astride the top edge of the vertical web 6 of a beam 4. Said stirrup-piece is held in position by means of a locking-pin 23 which can be engaged in any one of a series of holes 24 formed in the vertical web 6 of the corresponding beam 4. Since the post 20 is intended to be placed against the adjacent edges of two prefabricated panels, this possibility of modification of the position of its foot makes it possible to vary the length of the cells under construction.

For the same reason, the length of the external shore 21 is adjustable. To this end, said shore is constituted by two sectional members which are capable of sliding on each other and of being fixed in position at the required length by means of a locking-pin 25. Moreover, provision is made for a turnbuckle 26 which permits finer adjustment of length. At its lower end, said shore is fixed by means of another locking-pin 27 on the free end of an extension 28 provided at the end of each beam 4, beyond the transverse cheek 14 of this latter.

At its upper end, each post 20 is adapted to carry two hooks 29 formed by two metal rods 30 placed horizontally one above the other through the corresponding holes of said post. Said hooks are placed on the inside and the opposite ends of the metal rods 30 are adapted to carry tightening nuts 30*a*. Said metal rods are located within the gap which exists between two adjacent prefabricated panels 19. As to the hooks 29, they are accordingly placed as shown in FIG. 4 in order to engage within the vertical edges of the two corresponding panels 19 against the inner faces of the posts 31 provided on the edges of these panels. This accordingly makes it possible to immobilize these latter in the intended vertical position.

However, other complementary immobilization means can be provided at the lower end of each post 20 in order to perfect the temporary attachment of the panels 19.

In order to permit variations in width l of the cells 2, provision is made for a corresponding number of shuttering devices of variable width which are placed on the fabrication bed 1. Each of these devices comprises several sets of horizontal plates 35 which have different lengths and the edges of which are placed so as to be applied against metallic sectional members constituting each edge of the corresponding shutter. At an intermediate point of their length, the plates 35 also bear on a removable joist 36 which rests on bottom shoes 37.

The sides of each shuttering device consist in reality of two complementary metallic sectional members 38 and 39 which are engaged one within the other and slidably mounted on each other. Each sectional member is rigidly fixed at one end to a vertical end-plate 44 carried by a bearing shoe 45 (as shown in FIG. 6). The possibility of causing the two sectional members 38 and 39 to slide on each other in turn makes it possible to adjust at will the length of the sides of each shutter.

Insulation plates 39 of polystyrene, for example, can be placed on the plates 35 of the shutters prior to casting of the slabs 3. Additional insulation plates 40 can be placed on each side of the sides of the different shutters, said plates being intended to rest on sectional members 41.

Preferably, the horizontal sole-plate 5 of the beams 4 is adapted to carry electric heating resistors which are intended to accelerate setting of the concrete. In such a case, the resistors 42 are advantageously placed inside sectional members 43 which are mounted against the bottom face of the sole-plate 5 of each beam.

Moreover, the present installation is equipped with movable lifting means such as a traveling bridge crane, for example, which serves to lift each cell 2 after completion of fabrication in order to remove it from the bed 1 while leaving the subdividing beams 4 on this latter. In order to permit handling of the cells 2, provision is made for anchoring rods 48 which are intended to be incorporated in the side beams 17 of the cell slabs 3. The free end of each rod is engaged through a passageway 57 formed in the lower end of each side post 31 of the corresponding vertical panel 19. The end of said anchoring rod, which is flush with only the outer face of said panel, is intended to permit removable fastening of an external attachment fitting 46 by means of an internally threaded sleeve provided with an external operating head. These fittings permit the attachment of slings 47 employed for lifting each cell (as shown in FIG. 9). The attachment fittings 46 are intended to be subsequently removed whereas the anchoring rods 48 remain in position without any attendant disadvantage.

In order to produce a series of cells 2 constituting one construction unit, it is necessary to fix the subdividing beams 4 in positions corresponding to the intended width of the various cells. The different adjustable-shuttering devices are then placed by adapting these latter, not only to the width of the cells, but also to their length. The prefabricated panels 19 which are intended to constitute the external walls are then placed in position. These panels are disposed at the ends of the various cells in positions which depend on the intended length of each cell.

Figure 7:
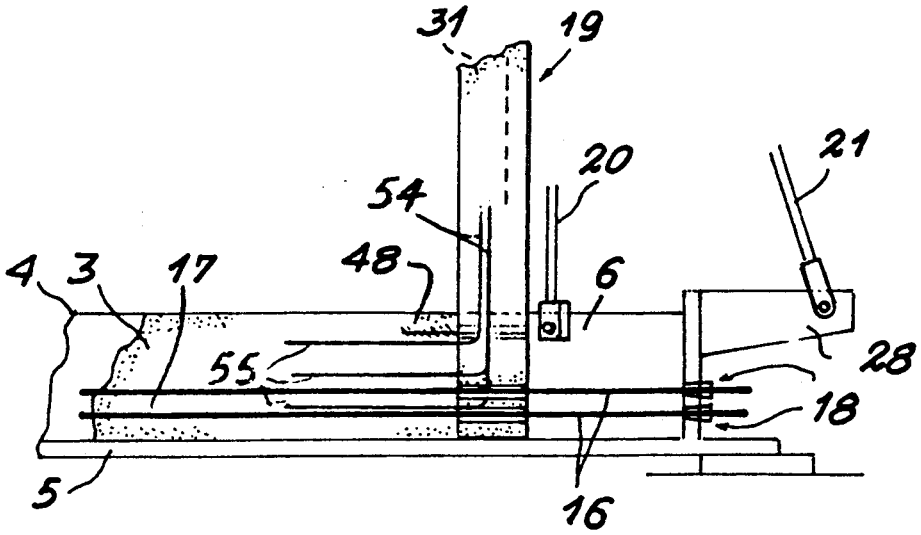
FIG. 7 is a partial vertical sectional view of one end of a cell.
Figure 8:
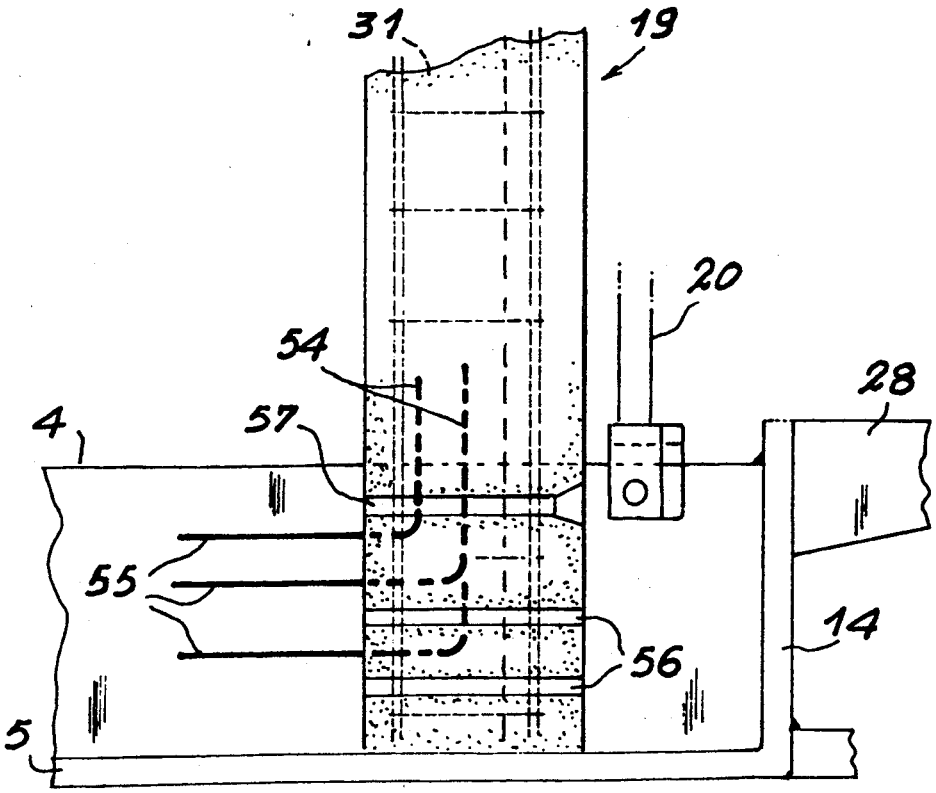
FIG. 8 is a similar view to a different scale and prior to casting of the concrete slab.

As illustrated in FIG. 8, the side posts 31 of each panel are provided at their lower ends with tie-bars 54, the ends 55 of which project horizontally outwards from the internal face of the corresponding panel. These end portions are thus intended to be incorporated within the side beams 17 of the slab 3 of the corresponding cell at the time of subsequent placement of the concrete (see FIG. 7). Moreover, the posts 31 are provided at their lower ends with horizontal passageways 56 for the tendons 16 used for prestressing the concrete of the slab 3, in addition to the passageway 57 through which the end of an anchoring rod 48 is intended to pass.

As can readily be understood, the position of the vertical posts 20 for immobilizing the panels 19 must be adjusted according to the length of the cells. It may therefore prove necessary to modify the length of the external shores 21.

When a predetermined cell is smaller in length than the other cells as is the case with the cell **2*a* in FIG. 1, it is necessary to provide a prefabricated panel 19*a* at the location of the corresponding recess. It will be readily apparent that other prefabricated panels can be placed at each end of the unit to be constructed in order to constitute external walls which extend at right angles with respect to the walls formed by the panels 19. In the same manner as these latter, said external panels must be temporarily secured in position prior to placement of the concrete which is intended to constitute the slabs 3** of the various cells.

As already mentioned, these slabs are formed by means of a single placement of concrete. However, by virtue of the presence of the subdividing beams 4, this single placement produces a succession of separate slabs 3 each forming part of one cell. In order to ensure surface flatness of the slabs thus cast, it is possible to use a leveling rule 52 by sliding this latter along the top edge of the vertical webs 6 of the two successive subdividing beams 4 (as shown in FIG. 5). However, at each end of a construction unit, it is not possible to slide a rule of this type along the top edge of the corresponding subdividing beam by reason of the presence of the foot of the prefabricated panel which forms the corresponding external wall. It is for this reason that the cheeks 14 provided at the ends of the subdividing beams 34 have two holes 53 located at the same level as the top edge of the vertical web 6 of the corresponding beam and on each side of said web. As the case may be, either of these two holes can receive a wire cable which can be fixed horizontally therein so as to serve as a guide for the leveling rule 52. Instead of a simple leveling rule, it is of course possible to employ a vibrating rule for consolidating the concrete.

Placement of the concrete which forms the slabs 3 also has the effect of immovably joining the vertical panels 19 and others to said slabs. Rigid interassembly is accordingly ensured by the tie-bars 54-55 provided at the lower ends of the panels 19 and embedded in the concrete of the slabs (as shown in FIG. 7). After setting of the concrete, this accordingly makes it possible to obtain cells 2 in a single block. However, as has already been mentioned, these cells remain independent of each other.

In an advantageous embodiment of the present installation, this latter comprises two fabrication beds 1 which are placed side by side and equipped in the same manner. With the same team of workers, it is thus possible to form two distinct construction units by taking advantage of the concrete setting time on one unit in order to work on the other. This accordingly results in a very considerable saving of time.

After setting of the concrete, the cells 2 can be removed by means of a movable lifting means such as a traveling bridge crane, for example, as already described with reference to FIG. 9. These different cells can then be placed side by side on another work surface and at this point can be entirely equipped in the factory. These cells can thus receive all desired equipment and decoration elements such as floors or wall-to-wall carpeting, wall linings, roofing elements and interior ceilings and all other types of technical equipment such as, for example, electrical cable ducts and corresponding appliances, water piping and sanitary equipment supplied by said piping, heating pipes and radiators connected to these latter, and so on.

What is claimed is:

1. An installation for the manufacture of a plurality of cells which are intended to constitute a construction unit, comprising: a concrete slab fabrication bed, plural transverse subdividing members for subdividing the bed so as to form a plurality of cell slabs on the bed between said subdividing members, attachment means for adjustably fixing said subdividing members selectively at a plurality of positions along the bed to vary the distance between adjacent members and thereby the width of each cell slab, and support means for supporting pairs of opposing vertical prefabricated panels on the bed with each pair being located between adjacent subdividing members, said support means including a plurality of vertical posts each having means for adjustably mounting the post on a corresponding subdividing member for adjustable positioning therealong, and each vertical post having means for engaging and holding at least one of said panels.

2. An installation according to claim 1, wherein said support means further include an external shore of adjustable length attached to each of said vertical posts.

3. An installation according to claim 1, further including a series of adjustable shuttering devices placed on the fabrication bed between the subdividing members in order to provide bottom shutters of said cell slabs, said shuttering devices each including sectional members having top edges, said sectional members being slidably mounted relative to each other so as to have an adjustable length, and each of said shuttering devices further including a top wall formed by plates removably placed on the top edges of the sectional members.

4. An installation according to claim 1, wherein each said cell slab includes edges, and said subdividing members have ends each adapted to carry a vertical cheek which is placed transversely to the longitudinal extension of the associated subdividing member and which is pierced with holes for supporting reinforcement rods over the entire length of the edges of each cell slab in order to fabricate corresponding side beams of the cell slabs having prestressed reinforcement rods therein.

5. An installation according to claim 1, further including means on said panels for supporting anchoring means adapted to be incorporated in ends of the cell slabs for receiving attachment fittings which serve to lift said cell slabs one by one after fabrication while leaving the subdividing members in position.

6. An installation according to claim 1, wherein the attachment means for adjustably fixing the subsdividing members include a series of holes provided in succession on the fabrication bed for defining different positions for said subdividing members, said holes adapted to receive removable locking pins which are also engaged in slots formed at ends of said subdividing members.

7. An installation according to claim 6, wherein the fabrication bed has a center line and the subdividing members have a central portion, said fabrication bed including another series of holes which extend along its center line and which are adapted to receive removable pins for attaching the subdividing members in their central portion.

8. An installation according to claim 1, wherein each post includes a lower end thereof having a stirrup piece mounted astride a top edge of a corresponding subdividing member, and said means for adjustably mounting the post includes a locking pin associated with the stirrup piece and engaged in any one of a series of holes formed in said subdividing member.

9. An installation according to claim 1, wherein each post is adapted to carry at an upper end thereof two hooks which are adapted to be placed in a gap located between two of said prefabricated panels for hooking onto an internal face of each panel.

10. An installation according to claim 1, wherein the subdividing members carry electric heating resistors for accelerating the setting of concrete.

* * * * *